US006213715B1

(12) United States Patent
Larochelle et al.

(10) Patent No.: US 6,213,715 B1
(45) Date of Patent: Apr. 10, 2001

(54) FAN STRUCTURE HAVING A SPHERICAL FOUR-BAR MECHANISM

(75) Inventors: Pierre Marc Larochelle, West Melbourne; Stacy Lyn Dees, Indialantic; John Simon Ketchel, Fort Myers, all of FL (US)

(73) Assignee: Florida Institute of Technology, Melbourne, FL (US)

( * ) Notice: Subject to any disclaimer, the term of this patent is extended or adjusted under 35 U.S.C. 154(b) by 0 days.

(21) Appl. No.: 09/395,991

(22) Filed: Sep. 15, 1999

Related U.S. Application Data

(60) Provisional application No. 60/100,481, filed on Sep. 16, 1998.

(51) Int. Cl.[7] ..... F04D 29/32

(52) U.S. Cl. ..... 416/110; 416/1; 74/63; 74/68

(58) Field of Search ..... 416/1, 98, 100, 416/108, 110; 74/63, 68; 33/24.1, 21.1, 21.2, 27.01

(56) References Cited

U.S. PATENT DOCUMENTS 5,556,256 * 9/1996 Shao ..... 416/100
6,026,703 * 2/2000 Stanisic et al. ..... 74/490.06

FOREIGN PATENT DOCUMENTS

1032466 * 6/1958 (DE) ..... 416/100
4404831 * 12/1994 (DE) .

OTHER PUBLICATIONS

Norton, "An Introduction to the Synthesis and Analysis of Mechanisms and Machines", *Design of Machinery*, 1999, USA.

Erdman, *Mechanism Design Analysis and Synthesis, Second Edition*, 1991, USA.

Larochelle, "Design of Cooperating Robots and Spatial Mechanisms", Dissertation Submitted in Partial Satisfaction of the Requirements for the Degree of Doctor of Philosophy in Engineering, University of California Irvine, 1994, USA.

Chiang, *Kinematic of Spherical Mechanisms*, 1996, Taiwan.

Chironis, *Mechanisms and Mechanical Devices Sourcebook*, 1991, USA.

Hartenberg, *Kinematic Synthesis of Linkages*, 1964, USA.

* cited by examiner

*Primary Examiner*—Edward K. Look
*Assistant Examiner*—Liam McDowell
(74) *Attorney, Agent, or Firm*—Manelli Denison & Selter PLLC; Edward J. Stemberger

(57) ABSTRACT

A fan structure includes a fan head having a plurality of blades mounted for rotation. A mechanism is coupled to the fan head and is constructed and arranged to move the fan head along a surface of a sphere in a three dimensional pattern. At least one motor is constructed and arranged to cause rotation of the blades and movement of the mechanism. The mechanism thus provides both back-and-forth and up-and-down motion of the fan head.

16 Claims, 5 Drawing Sheets

FAN STRUCTURE HAVING A SPHERICAL FOUR-BAR MECHANISM

This application claims the benefit of U.S. Provisional Application 60/100,481 entitled "Infinity Fan" filed on Sep. 16, 1998, the content of which is hereby incorporated into the present specification by reference.

FIELD OF THE INVENTION

This invention relates to a cooling fan and, more particularly, to a fan structure which has a spherical four-bar mechanism to permit the fan to move back-and-forth and up-and-down.

BACKGROUND OF THE INVENTION

A conventional cooling fan, either of the desktop or free standing type, oscillates in a generally horizontal plane to provide back-and-forth motion. This motion is achieved by a motor to drive the fan blades directly as well as to drive a gear train which causes rotation of an output shaft at a greatly reduced speed. The reduced speed output is typically used to drive a planar four-bar mechanism which generates the back-and forth motion of the fan head. Although this motion has some cooling benefit as compared to a non-oscillating fan, the motion can be improved.

Accordingly, there is a need to provide a fan structure which is capable of moving in three spatial planes to cause a fan head to move back-and-forth as well as up-and-down.

SUMMARY OF THE INVENTION

An object of the present invention is to fulfill the need referred to above. In accordance with the principles of the present invention, this objective is obtained by providing a fan structure including a fan head having a plurality of blades mounted for rotation. A mechanism is coupled to the fan head and is constructed and arranged to move the fan head along a surface of a sphere in a three dimensional pattern. At least one motor is constructed and arranged to cause rotation of the blades and movement of the mechanism. The mechanism thus provides both back-and-forth and up-and-down motion of the fan head.

In accordance with another aspect of the invention, a method provided to move an object in three spatial planes. The method includes defining a reference coordinate system having an origin at a center of a sphere. Four links are then pivotally coupled together at four joints such that axes of the joints intersect at the origin thereby defining a spherical four-bar mechanism. An object is coupled to one of the links. The mechanism is caused to move which causes movement of the object along a surface of the sphere in a three dimensional pattern.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

The fan structure of the invention employs a spherical four-bar mechanism which generates the unique ∞ "infinity" motion of the fan head. The symbol ∞ as used herein depicts the three-dimensional pattern of movement of the four-bar mechanism of the invention. A spherical four-bar mechanism consists of four links connected by four revolute joints (pin or hinge joints). A body undergoing spherical motion has three degrees of freedom. The degrees of freedom may be interpreted as rotation about three mutually perpendicular axes passing through the center of a sphere. This constrains spherical motion to be purely rotational. The rotations may be about a fixed axis or an instantaneous axis. In either case, the axis still must pass through the center of the sphere. Hence, the axes of the four revolute joints of spherical mechanisms must intersect in the sphere center.

Figure 1A:
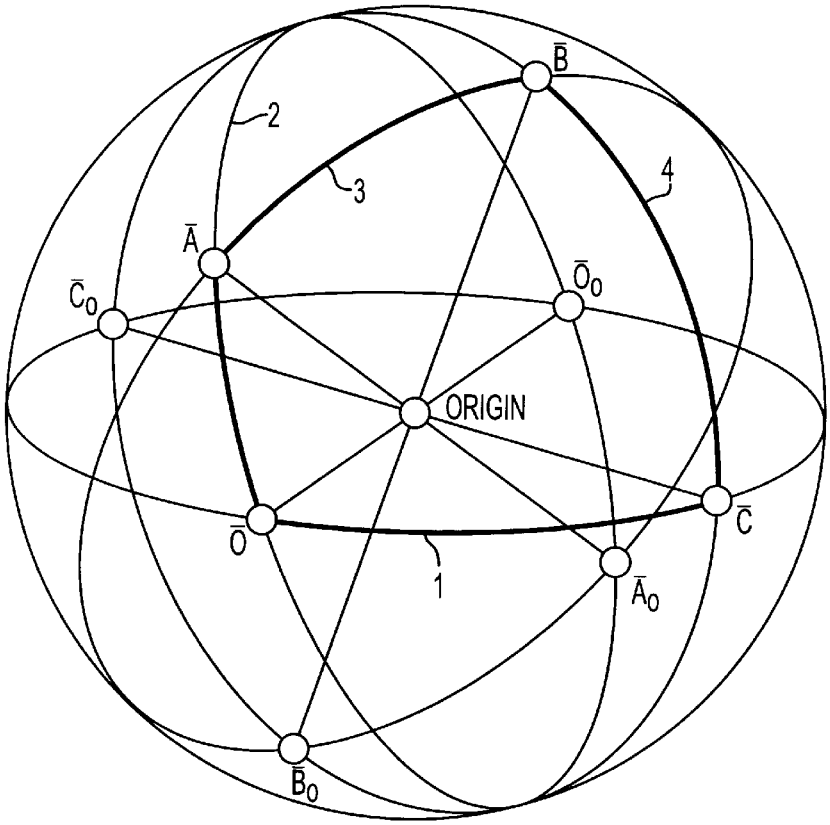
FIG. 1*a* is a view of the intersection of four great circles and the resulting axes of rotation used to explained a spherical four-bar mechanism.
Figure 1B:
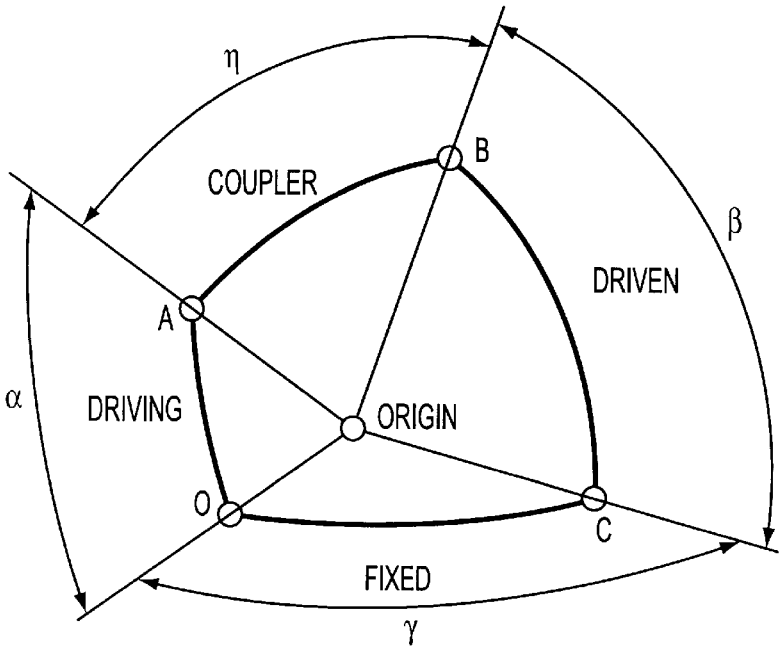
FIG. 1*b* shows a spherical four-bar linkage and link name notation as obtained from the great circles of FIG. 1*a;*

An axis of rotation is defined by a unit vector whose origin is at the center of the sphere. The unit vector defines the direction of the line about which the spherical link rotates. In spherical kinematics, a link is characterized by the great circle arc subtended by it's two joints at the center of the sphere and the angular length of this arc is defined as the link's length. A great circle is any circle lying on the surface of a sphere whose radius is the same as the radius of the sphere. Two great circles intersect at two points on the sphere and define a line in space. This line passes through the center of the sphere. Unit vectors originating from the sphere center along the line in either direction define the axis of rotation. FIG. 1*a* shows the intersection of four great circles and the resulting axes of rotation and FIG. 1*b* shows a spherical four-bar linkage axes and link name notation.

Figure 2:
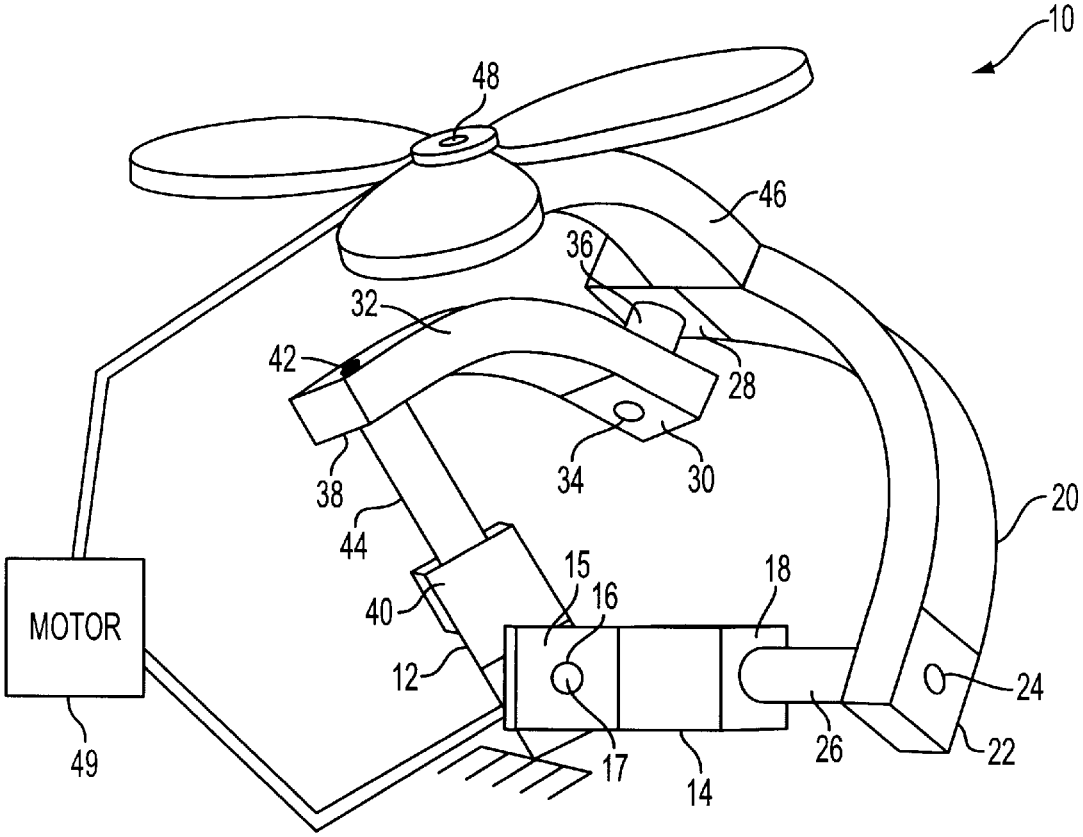
FIG. 2 is a perspective view of a fan structure having a spherical four-bar mechanism, provided in accordance with the principles of the present invention.

Referring to FIG. 2, a fan structure is shown, generally indicated 10, provided in accordance with the principles of the present invention. Using the link name notation of FIG. 1*b*, the fan structure comprises a fixed link 12 which may be fixed to a base or the like. A driving link 14 is pivotally coupled at end 15 to the fixed link 12 via a pin connection 16. The pin connection 16 is achieved by a rod or pin 17 rotatably coupled between the fixed link 12 and the driving link 14. In the illustrated embodiment, the pin 17 is about 0.5 inches in length. End 18 of the driving link 14 is pivotally coupled to a coupler link 20 at end 22 thereof via pin connection 24. The pin connection 24 is achieved by a rod or pin 26 rotatably coupled between the driving link 14 and the coupler link 20. In the embodiment, the pin 26 is preferably about 1.5 inches in length. End 28 of the coupler link 20 is pivotally coupled to end 30 of a driven link 32 via a pin connection 34. The pin connection 34 is achieved by a rod or pin 36 rotatably coupled between the coupler link 20 and the driven link 32. In the embodiment, the pin 36 is preferably about 0.5 inches in length. End 38 of the driven link 32 is pivotally connected to the end 40 of the fixed link 12 via a pin connection 42. The pin connection 42 is achieved by a rod or pin 44 rotatably coupled between the driven link 32 and the fixed link 12. In the embodiment, the pin 36 is preferably about 1.5 inches in length. Thus, the fixed link 12, the driving link 14, the coupler link 20 and the driven link 32 define the four links of a spherical four-bar mechanism of the invention. A motor 49 is coupled to the driving link 14 and to the fan head 48 to provide movement to the four-bar mechanism and to rotate the fan head 48, as will be explained more fully below. Each pin connection of the mechanism may include bearings (not shown).

Attaching the moving body (for example, a fan head) to the coupler link 20 usually requires additional parts: a coupler extension and/or a coupler attachment. As shown in FIG. 2, a coupler attachment 46 attaches the fan head 48 to the coupler link 20. In FIG. 2, since the coupler attachment 46 is mounted on a length of the coupler link 20, there is no need for a coupler extension to extend the coupler link 20.

The coupler extension is an arc length that lies in the same plane and has the same radius as the coupler link 20. The coupler extension either lengthens the coupler link 20 or the coupler extension lies within the coupler link 20. This is possible because any point along the coupler link "great circle" could be the location of the moving body. The coupler attachment 46 has the same radius as the coupler link 20 and coupler extension. The coupler attachment 46 is connected normal to the coupler link 20, but still at the same spherical radius. The coupler link 20, coupler extension, and the coupler attachment 46 all have the same radius and lie on the surface of the same sphere. The result is a one degree of freedom mechanism which generates purely rotational motion. The exact motion generated by the mechanism is determined by the length of the four links 12,14, 20 and 32 and where the body to be moved (e.g., fan head) is attached to the mechanism. It is a unique and novel spherical four-bar mechanism of the invention (i.e., a set of four link lengths and a specific place to attach the moving body) which generates the ∞ "infinity" motion of the fan head 48.

Figure 3:
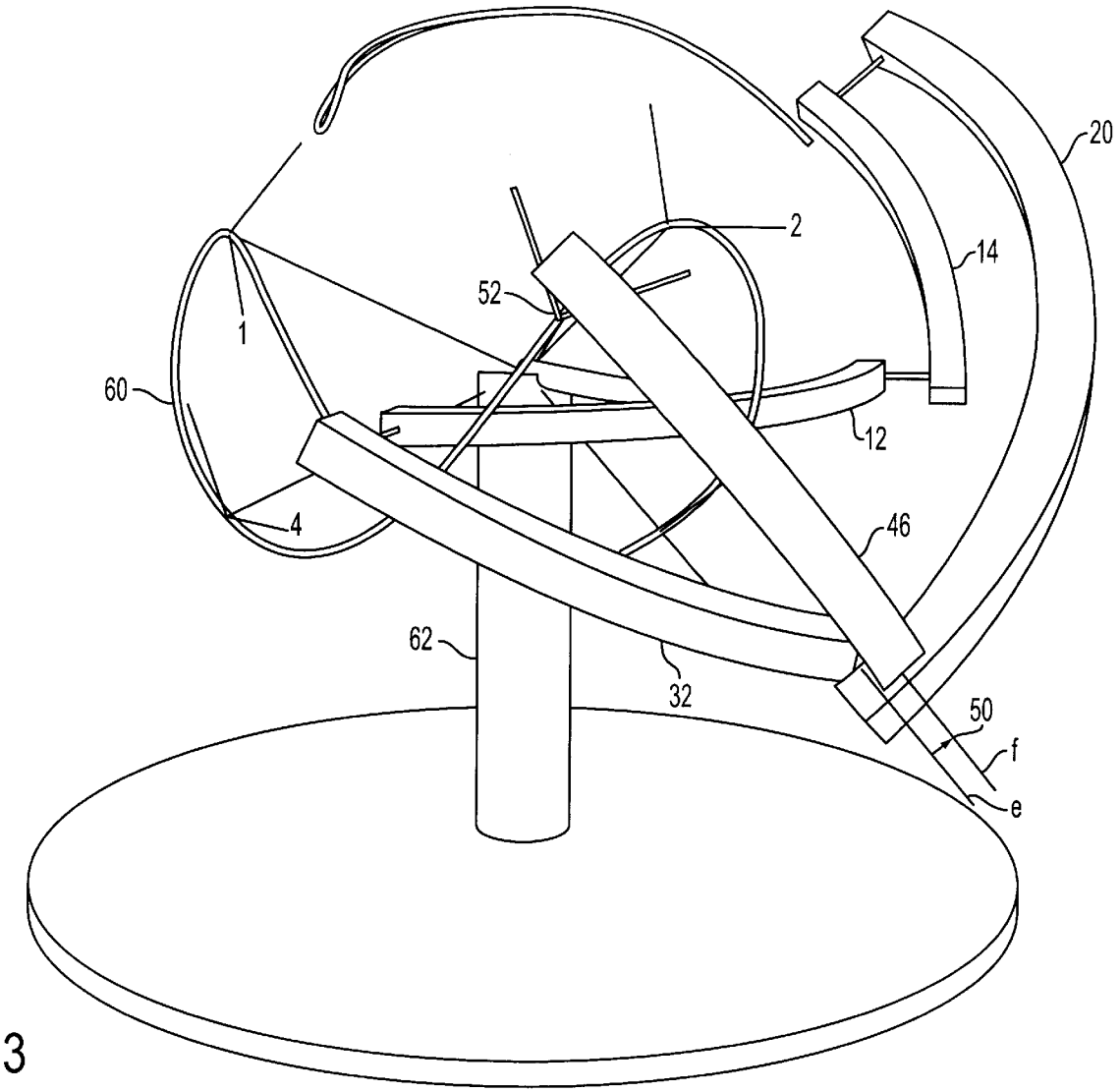
FIG. 3 is a perspective view of a spherical four-bar mechanism of the invention as generated by computer aided design software, showing the shape of movement produced by the mechanism.

The fan structure 10 was modeled using computer-aided design software entitled "Sphinx-1.2". The display of the mechanism of the invention using "Sphinx-1.2" is shown in FIG. 3. Note that the ∞ "infinity" path 60 is shown in FIG. 3 and represents the movement of the four-bar mechanism and thus the fan head (not shown in FIG. 3) which would be attached to point 52 (an origin of the coordinate frame on the ∞ "infinity" path). It is this specific attachment point 52 to the mechanism that traces out the ∞ "infinity" motion. Notice also the coupler attachment 46 and coupler extension 50 which connect the coordinate frame to the mechanism.

The numerical data which includes the four link lengths and the coupler extension and coupler attachment lengths, are listed below in the Table.

TABLE

Linkage Name: ./inf_fan
Linkage type: Crank-Rocker
Comment: This mechanism does not fold
Link lengths:
Driving: 47.350216 Driven: 53.806160
Coupler: 88.283920 Fixed: 87.894295
Link radii:
Driving: 1.150000 Driven: 1.300000
Coupler: 1.450000 Fixed: 1.000000

TABLE-continued

Driving fixed axis-o (in [F]):
X: 0.732747 Longitude: +132.88
Y: 0.000000 Latitude: +0.00
Z: −0.680501
Driving moving axis-a (in [M]):
X: 0.926299 Longitude: +87.30
Y: 0.374249 Latitude: +21.98
Z: 0.043682
Driven fixed axis-c (in [F]):
X: 0.703250 Longitude: +45.00
Y: −0.104311 Latitude: −5.99
Z: 0.703249
Driven moving axis-b (in [M]):
X: 0.272720 Longitude: +21.69
Y: −0.675005 Latitude: −42.45
Z: 0.685560
Theta-1 joint limits:
Min: −180.00 Max: +180.00
Sphinx kit angles:
Fixed link center longitude: +89.09
Fixed link center latitude: −4.15
Fixed link center roll: +4.32
Coupler extension length: −86.35
Coupler attachment length: −46.69

| Position-1: | Position-2: |
|---|---|
| Longitude: +10.00 | +80.00 |
| Latitude: +20.00 | +20.00 |
| Roll: −45.00 | +1.00 |
| Position-3: | Position-4: |
| Longitude: +80.00 | +10.00 |
| Latitude: −20.00 | −20.00 |
| Roll: −45.00 | +1.00 |

The fixed axes of the spherical four-bar mechanism are located with respect to a reference coordinate frame whose X-Z plane is horizontal and whose Y axis is oriented positive upwards. In other words, using a cartographers convention, the reference coordinate frame is located such that its is origin is at the center of the earth, that the equator lies in its X-Z plane, and the Y axis points up to the north pole.

With respect to this reference frame the directions of the fixed axes are given in the Table. Note that the Table alternatively locates the fixed axes with longitude and latitude angles expressed in degrees. Longitude is defined as a positive rotation about the Y axis and latitude is defined as a subsequent negative rotation about the X axis. The coupler extension 50 and coupler attachment 46 lengths are also listed in the Table in degrees.

Figure 4:
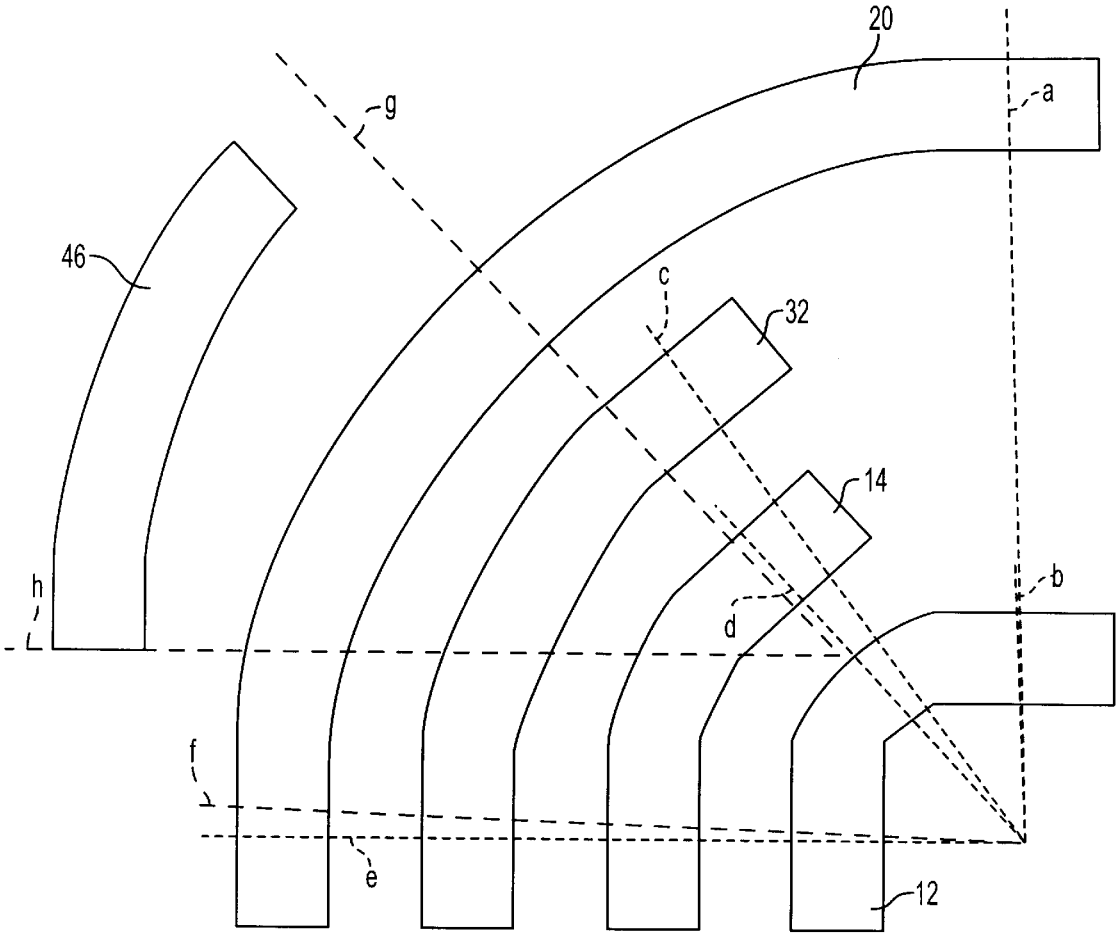
FIG. 4 is a plan view of the layout of links of the four-bar mechanism of FIG. 2.

The manufacturing layout of the four links 12, 14, 20, and 32 and the coupler attachment 46 and coupler extension is shown in FIG. 4. The links are oriented at the relative radii specified in the Table, i.e., the fixed link 12 is at the smallest radius. Note that the coupler attachment 46 is oriented above and to the left of the four links. The joint axes are located by the dashed lines a, b, c, d, and e and the long dashed line f indicates the end of the coupler extension, i.e., where to connect the coupler attachment 46 to the coupler link 20. The coupler extension is shown in FIG. 3 with reference to lines e and f of FIG. 4. The coupler extension 50 length is measured from the line a to line f in FIG. 4 with positive sense being clockwise. Similarly, the coupler attachment length is measure for the line h to the line g in FIG. 4.

The manufacturing instructions for providing the spherical four-bar mechanism of the invention are as follows. First, the desired fan base, links and attachment are manufactured per the layout shown in FIG. 4. Next, axis holes are made in the links 12, 14, 20 and 32 as indicated by the dashed lines a, b, c, d, and e, in FIG. 4. To assemble the mechanism, the links are connected to the base to form a spherical closed chain as follows. A reference coordinate frame is located on a fan base 62 (FIG. 3). Recall that the fan structure 10 will move the fan head 48 on the surface of a sphere whose center is at the origin of the reference frame. Once this frame has been assigned, the axes of the fixed link 12 are located using either the longitude and latitude angles or the unit vectors listed in the Table. The fixed link 12 is then attached to the base 62. Next, the driving link 14 is attached to the fixed link 12 at the driving fixed axis d using a pin and bearings as appropriate. The driven link 32 is then similarly attached to the fixed link 12 at axis c. The coupler attachment 46 is then rigidly connected to the coupler link 20 at the location indicated by the long dashed line f in FIG. 4. The coupler link 20 is connected using pins and bearings as appropriate to the two free ends of the driving and driven links as shown in FIGS. 2 and 3. Finally, the fan head 48 (FIG. 2) is rigidly attached to the end of the coupler attachment 46 such that the axis of rotation of the fan blades passes through the origin of the reference coordinate frame. When the links are properly assembled, lines f and g of the coupler attachment 46 and coupler link 20, respectively, are coincident. With reference to FIG. 4, the coupler attachment 46 is rotated 90 degrees with respect to the plane of the page and line f coincides with line g.

In the preferred embodiment, a single motor is used to rotate the fan blades and to move the four-bar mechanism of the invention. It can be appreciated, however, that one motor may be provided to rotate the fan blades and a separate motor may be provided to cause movement of the mechanism.

Figure 5:
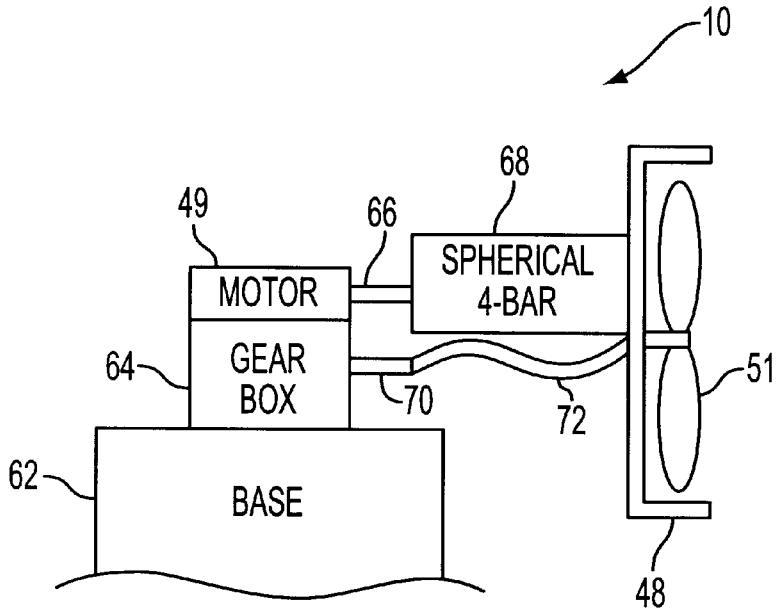
FIG. 5 is a schematic illustration of the fan structure of the invention showing one embodiment of motor connection.

FIG. 5 is a schematic illustration of a preferred motor 49 connection of the fan structure 10. The motor 49 includes a gearbox associated therewith to define a motor/gearbox 64 which is carried by the base 62. The motor/gearbox 64 has a first, relatively slow rotating output shaft 66 coupled to the spherical four-bar mechanism 68 to drive mechanism 68 and thus move the fan head 48 in the ∞ pattern. The motor/gearbox 64 has a second, fast (relative to the first output shaft) rotating output shaft 70 preferably coupled to the fan blades 51 by a conventional, flexible rotating coupler 72 to cause rotation of the fan blades 51. The flexible coupler 72 includes a flexible shaft carried within a protective flexible outer covering. Accordingly, both the spherical four-bar mechanism 68 and the fan blades 51 may be concurrently driven at different rotational speeds using a single motor 49.

Figure 6:
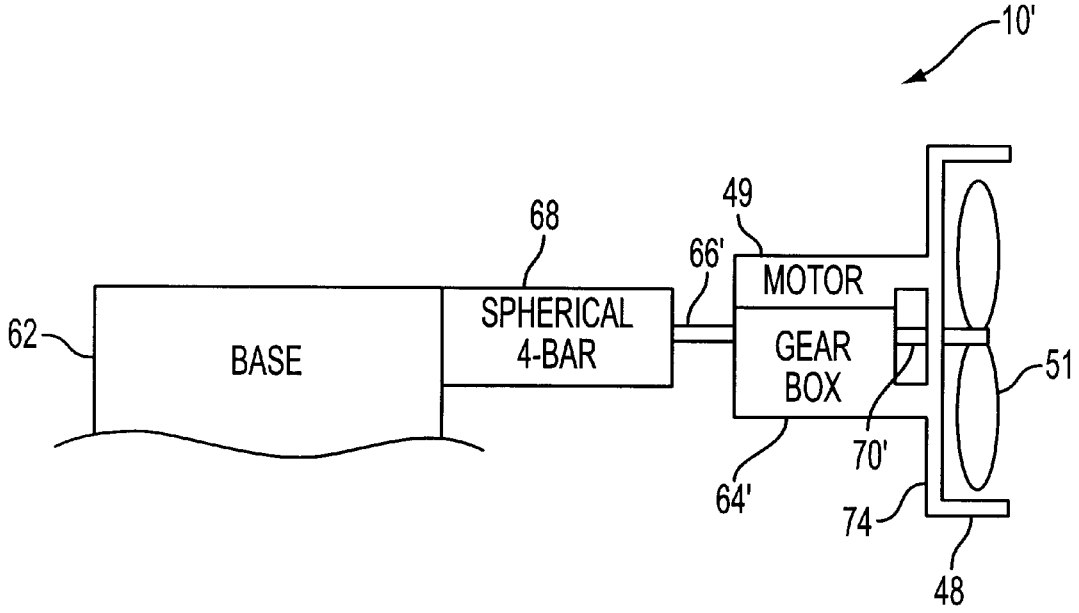
FIG. 6 is a schematic illustration of the fan structure of the invention showing another embodiment of motor connection.

FIG. 6 shows another embodiment of the fan structure 10' wherein the motor/gearbox 64' is carried by a housing 74 of fan head 48. The four-bar mechanism 68 is carried by the base 62 and the housing 74 is carried by the other end of the mechanism 68. The motor/gearbox gear 64' has a slow rotating output shaft 66' coupled to drive the mechanism 68, and a faster output shaft 70' is coupled to drive the fan blades 51. Of course, in yet another embodiment, the motor 49 may directly drive the fan blades 51 and gearing may be used to drive the spherical four-bar mechanism 68 more slowly such that the fan head 48 moves in the ∞ "infinity' motion.

When the motor 49 is activated to cause motion of the four-bar mechanism 68 of the invention, the fan head 48 is moved by the mechanism such that the fan head spans about 80 degrees in the horizontal plane and about 40 degrees in the vertical plane. Traditional desktop and free standing fans generate a planar back-and-forth (i.e. horizontal plane) motion and no up-and-down (i.e. vertical) motion.

An advantage of the fan structure 10 of the invention is that the fan head moves in a three dimensional ∞ "infinity" pattern rather than the conventional back-and-forth motion of existing fan designs. Moreover, this new three dimensional motion is generated by a spherical four-bar mechanism. The use of the novel spherical mechanism means that the fan structure can generate both the rotation of the fan blades and the ∞ "infinity" motion of the fan head with one motor. The ∞ "infinity'" motion of the fan head is a significant improvement over existing oscillating fan designs yet no additional motors are required. The result is that the fan structure of the invention is comparable in price to current fan designs yet it provides improved cooling and comfort to the consumer.

The spherical four-bar mechanism of the invention may be used to drive other objects besides a fan head in the ∞ "infinity" pattern. For example, other applications include (but not limited to) the following:

Stirring/Mixing Applications-turn the mechanism "up-side-down" and attach a mixing blade in place of the fan head.

Security Camera—attach a security camera in place of the fan head.

Indoor Ceiling Fan—turn the fan structure "up-side-down'" and suspend it from a ceiling.

Motorized Target—attach a target in place of the fan head for shooting practice, pinball machines, etc.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan structure comprising:

a fan head including a plurality of blades mounted for rotation;

a mechanism coupled to the fan head and constructed and arranged to move the fan head along a surface of a sphere in a three dimensional pattern including horizontal and vertical motion; and at least one motor constructed and arranged to cause rotation of the blades and movement of the mechanism.

2. The fan structure according to claim 1, wherein the mechanism comprises a spherical four-bar mechanism having four links connected by four pivotal joints, axes of the four joints intersecting a center of the sphere.

3. The fan structure according to claim 2, wherein the four links include a fixed link, a driven link, a coupler link and a driving link, an end of the fixed link being pivotally coupled to the driven link, an end of the driven link being pivotally coupled to the coupler link, and end of the coupler link being pivotally coupled to the driving link, and an end of the driving link being pivotally coupled to the fixed link.

4. The fan structure according to claim 3, further comprising an coupler extension and a coupler attachment for coupling the fan head to the coupler link, the coupler extension being an arc length that lies in same plane as the coupler link and has the same radius as the coupler link and is operatively associated with the coupler link, the coupler attachment has the same radius as the coupler link and is connected normal to the coupler link, the fan head being coupled to the coupler attachment.

5. The fan structure according to claim 1, wherein a gearbox is associated with said at least one motor to define a motor/gearbox combination, said combination having a first output shaft for driving the mechanism and a second output shaft for rotating the blades, the combination causing the second output shaft to rotate at a speed greater than a speed of the first output shaft.

6. The fan structure according to claim 5, wherein a flexible coupler is couples the blades to the second shaft such that the flexible coupler transmits rotary motion of the second shaft to the blades.

7. The fan structure according to claim 1, wherein said mechanism is constructed and arranged to move said fan head so as to span approximately 80 degrees in a horizontal plane and approximately 40 degrees in a vertical plane.

8. An apparatus comprising:

a spherical four-bar mechanism comprising four links pivotally connected together at four joints, axes of said joints intersecting a center of the sphere;

an object coupled to one of the links so as to be moved by the mechanism along a surface of the sphere in a three dimensional patten including horizontal and vertical motion; and a motor opertively associated with the mechanism to cause movement of the mechanism, wherein the object is a fan head having a plurality of blades, said fan head being rigidly attached to said one link such that an axis of rotation of said blades passes through the center of the sphere.

9. The apparatus according to claim 8, wherein the mechanism is constructed and arranged to move the object so as to span approximately 80 degrees in a horizontal plane and approximately 40 degrees in a vertical plane.

10. The apparatus according to claim 8, wherein the fan head has a plurality of blades mounted for rotation, the motor being operatively associated with the blades to rotate the blades.

11. The apparatus according to claim 8, wherein the four links include a fixed link, a driven link, a coupler link and a driving link, an end of the fixed link being pivotally coupled to the driven link, an end of the driven link being pivotally coupled to the coupler link, and end of the coupler link being pivotally coupled to the driving link, and an end of the driving link being pivotally coupled to the fixed link.

12. The apparatus according to claim 11, further comprising an extension coupler and a coupler attachment for coupling the object to the coupler link, the coupler extension being an arc length that lies in same plane as the coupler link and has the same radius as the coupler link and is operatively associated with the coupler link, the coupler attachment has the same radius as the coupler link and is connected normal to the coupler link, the object being coupled to the coupler attachment.

13. The apparatus according to claim 10, wherein a gearbox is associated with the motor to define a motor/gearbox combination, the combination having a first output shaft for driving the mechanism and a second output shaft for rotating the blades, the combination causing the second output shaft to rotate at a speed greater than a speed of the first output shaft.

14. The apparatus according to claim 13, wherein a flexible coupler couples the blades to the second shaft such that the flexible coupler transmits rotary motion of the second shaft to the blades.

15. A method of providing an apparatus to move an object in three spatial planes, the method including:

defining a reference coordinate system having an origin at a center of a sphere, pivotally coupling four links together at four joints such that axes of said joints intersect at said origin thereby defining a spherical four bar mechanism, coupling an object to one of said links, and casing movement of said mechanism so as to cause movement of said object along a surface of the sphere in a three dimensional pattern, wherein said object is a fan head having a plurality of blades, said fan head being rigidly attached to said one link such that an axis of rotation of said blades passes through said origin.

16. The method according to claim 15, wherein the object is moved so as to span approximately 80 degrees in a horizontal plane and approximately 40 degrees in a vertical plane.

* * * * *